United States Patent [19]

Herrmann, Jr. et al.

[11] 4,104,521

[45] Aug. 1, 1978

[54] COROTRON CONNECTOR

[75] Inventors: Henry Otto Herrmann, Jr., Mt. Joy; Douglas Wade Glover, Harrisburg, both of Pa.

[73] Assignee: AMP Incorporated, Harrisburg, Pa.

[21] Appl. No.: 795,050

[22] Filed: May 9, 1977

Related U.S. Application Data

[63] Continuation-in-part of Ser. No. 675,412, Apr. 9, 1976, abandoned, which is a continuation-in-part of Ser. No. 673,037, Apr. 2, 1976, abandoned.

[51] Int. Cl.[2] ..... H01T 19/04

[52] U.S. Cl. ..... 250/324; 250/493; 250/522

[58] Field of Search ..... 96/1 CH; 355/3 R; 250/324, 325, 326, 423, 426, 277, 493, 522

[56] References Cited

U.S. PATENT DOCUMENTS

| | | | |
|---|---|---|---|
| 3,374,348 | 3/1968 | Ostensen | 250/325 |
| 3,736,424 | 5/1973 | Cecil | 250/324 |
| 3,770,972 | 11/1973 | Hartwell | 250/324 |
| 3,778,622 | 12/1973 | Kobayashi | 250/326 |

*Primary Examiner*—Harold A. Dixon
*Attorney, Agent, or Firm*—Russell J. Egan

[57] ABSTRACT

A connector incorporating a corotron which is in the form of an elongate high voltage carrying conductor which creates a high voltage space charge distributed evenly along the conductor length. The connector includes a dielectric channel into which are plugged dielectric end blocks which precisely position and maintain a straight length of the conductor in free space. Means are provided to tension the conductor and to compensate for dimensional changes thereof. Other means provide safe pluggable connection of the conductor to a source of high voltage. The connector is fabricated from component parts readily assembled without the need for special tooling.

13 Claims, 19 Drawing Figures

Fig. 11
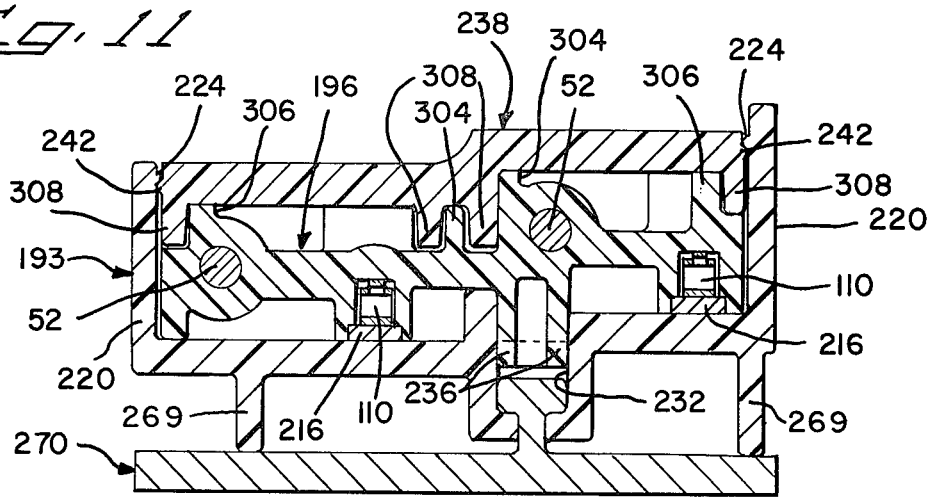
Fig. 13
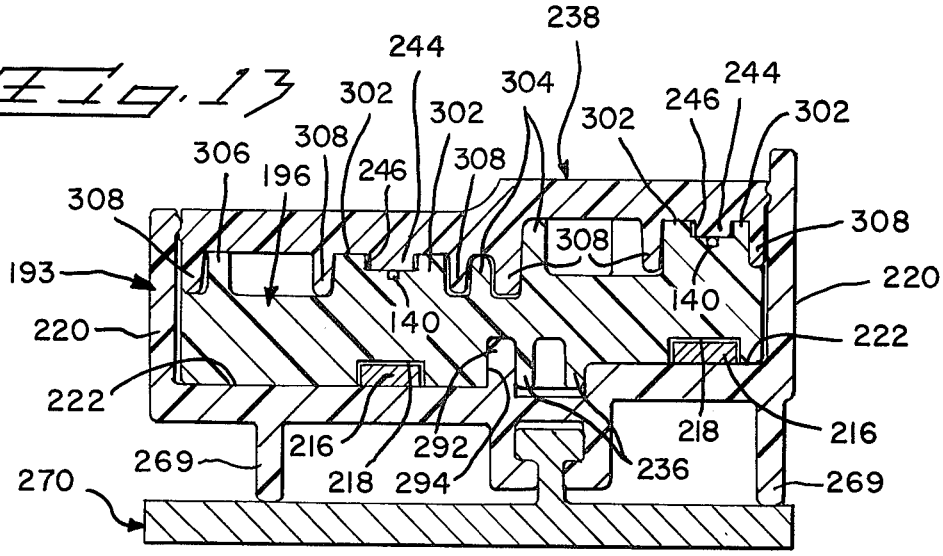
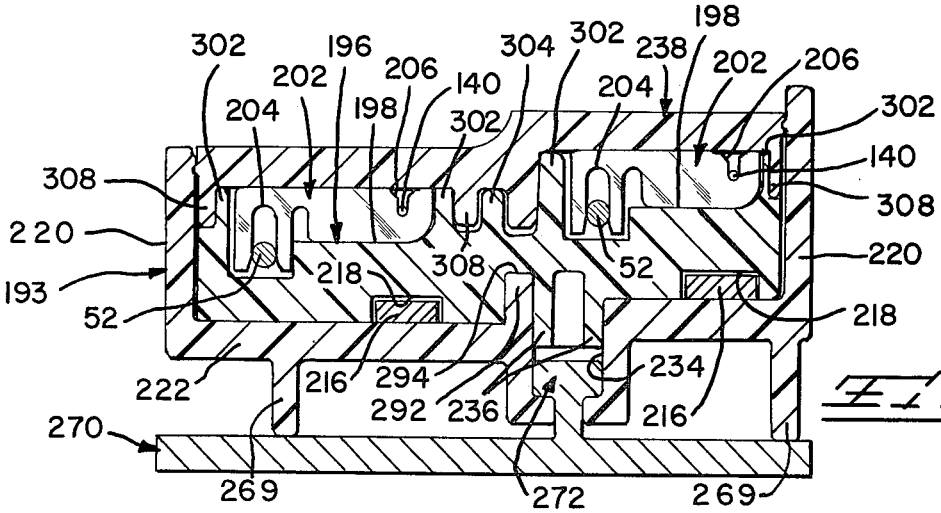
Fig. 12

COROTRON CONNECTOR

CROSS REFERENCE TO RELATED APPLICATIONS

This application is a continuation-in-part of application Ser. No. 675,412, filed Apr. 9, 1976 which is a continuation-in-part of application Ser. No. 673,037, filed Apr. 2, 1976 and both are now abandoned.

The present invention relates to an electrical connector and more specifically to a connector which while mounting one or more electrical conductors in free space also provides a means for connecting each conductor to a source of high voltage. The high voltage produces an electrostatic space charge surrounding a length of the conductor. The space charge is useful in various stages of the image duplicating art to transfer copy paper or to impel processing chemicals electrostatically. The conductor together with a tray or other means for supporting the conductor in free space is known in the art as a corotron. As technology advancements improved the duplicating processes, more exacting performance of a corotron became necessary. The impressed voltage originally DC was changed to AC in order to accommodate levels higher than ever before used. This created a need for safeguarding a user from the AC voltage when connecting or disconnecting the corotron thereto. Additionally there became a need for electrical insulation which would withstand the ozone generation and elevated temperatures resulting from the stresses of AC high voltage. The electrostatically charged conductor itself would undergo severe mechanical vibration when experiencing high AC voltages and would break or would even possibly become dislodged from its mounting assembly. The conductor also would distort by expansion and contraction in response to temperature variation. As a consequence the high voltage space charge distributed along the conductor would become undesirably distorted thus operating unreliably to transfer copy paper or to impel processing chemicals.

In times before the present invention it was a practice to tension the conductor and clamp down a length of it upon spaced mounting blocks. This technique although successful in the assembly of prior art corotrons proved inadequate to withstand the electrical and mechanical stresses at high AC voltages. Clamps were inexpensive but kinked or somehow otherwise damaged the conductor enhancing its tendency to snap under stress. The amount of tension placed upon the conductor varied from assembly to assembly such that distortion as among the conductors was random and unpredictable, making it impossible to compensate for. It was originally predicted that expensive assembly equipment would be required to achieve and apply tension of desired consistency in every conductor. Also to secure the conductor in place without overstress and with allowance for dimensional changes would require a fastener, if one could be found to exist, at some increased purchase cost which would propel the accumulated cost of a duplicating system toward a prohibitive level.

Working on the problem of corotron design was heretofore thought to be entirely separable from design of a connector or the hooking-up of a corotron to the high voltage source. It was assumed that once mounting the conductor successfully on a properly designed mounting assembly, one was freed of that problem to work on a design for an electrical connector. This proved to be fallacious, and became evident when various attempts at corotron designs were met with setbacks. There still existed the problem during assembly that special equipment was necessary to gauge and apply the requisite tension on each conductor. Difficulty was also experienced in maintaining tension on each conductor while attempting to secure the conductor on a mounting assembly. Then too there existed the expense of a commercially available fastener for the conductor, particularly if special equipment or skillful labor was necessary for its incorporation into the corotron.

In view of such foreseen expense and complexity, it became a desirable goal to devise a mounting technique for the conductor which would insure both maintenance of proper tension and relative ease in assembly of the conductor without inordinate skillful and complex assembly procedures or special tooling. There too there was a need to precisely align and position the conductor in free space without causing electrical shorts or an imbalanced concentration of electrostatic forces due to distortion in the conductor and variations in its orientation. Also there was the coincident problem of providing electrical insulation adequate to withstand high voltage and thermal variation. Persons reasonably skilled in the art prior to the invention were afraid that ozone generation would have to be substantially eliminated by the corotron design in order to except a reasonable life expectany of the corotron. Finally a mounting technique for the conductor which would solve all the above problems was further constrained by the limited available space in a duplicating apparatus as prescribed by its designers. Against this background of the prior art the present invention presented itself.

BRIEF DESCRIPTION OF THE INVENTION

The first hurdle to overcome was the selection of a dielectric material such as DELRIN which would withstand the anticipated electrical stress and ozone generation in the corotron. It was thought to let the corona occur rather than eliminate it, despite the skepticism on the part of the manufacturer of a duplicating apparatus. However the manufacturer became convinced that the present invention could withstand the corona and temperature variations without going through the trouble and expense of eliminating corona. In addition there was a need for designing a connector for the corotron which would meet the international specifications for creepage and clearance distances without increasing the size of the corotron or its connector.

Because of the electrical and mechanical requirements imposed upon the corotron it became apparent that an electrical hook-up technique separate from the corotron itself would not solve a sufficient number of encountered problems. It became apparent instead that the corotron itself would have to be redesigned such that it would itself become the sought after high voltage electrical connector.

The selection of a proper dielectric material for the corotron was an important contribution to the present invention. Such a dielectric was most advantageously fabricated by molding which allows for repeatability in manufacturing. Also close tolerancing of the molded parts could be achieved and thereby used advantageously to insure precise positioning of the conductor and other assembled parts. It was also advantageous to incorporate directly into the molded dielectric the precise means or technique for fastening the conductor in place. This would eliminate the need for a commercially available fastener and the problem of its assembly or incorporation within a corotron. Wherever assembly of component parts was found to be necessary, the parts could advantageously be molded so as to interfit together in desired orientations. Molded parts also could interlock or latch together for ease in assembly without the need for fasteners. Recesses or cavities in the molded parts would support the ends of the conductor. The conductor would be tensioned by a coil spring merely dropped into the cavities. A dielectric cover plate would then be snapped in place to cover the ends of the conductor. Precisely molded grooves communicating with the cavities would support a substantial length of the conductor and thereby precisely position the conductor in free space without applying undue stress concentrations on the conductor. A slotted plate type electrical contact also supported in a recess of the molded dielectric would be coupled to the conductor without a need for special assembly equipment. The slotted plate contact also could be readily provided with a high voltage dielectric plug to allow for ease in plugging when connecting the conductor to a source of high voltage. At a remote end of the corotron dielectric handles would be incorporated for ease in handling the corotron and also to identify the correct end of the corotron which a user could grasp safely remote from a source of high voltage. A bias voltage connection to the outboard end of the corotron could also be accommodated by an electrically safe electrical plug integral with the molded dielectric and made accessible adjacent to the handle.

The component parts of the corotron of the present invention are readily assembled without the need for special equipment or tooling. The dielectric components latchably interlock when properly assembled in their final positions. The conductors are merely dropped into place within the grooves and cavities of the corotron and within the slots of the slotted plate contact. Each of the conductors are precisely positioned in free space and are recessed within the grooves of the corotron which serve as frets to support the conductor in free space. Coil springs assembled over the conductors and in compression within the provided cavities maintain tension on the conductors and allow for considerable expansion and contraction thereof without permitting distortion. The mounted position of each corotron conductor is consistent from corotron to corotron and is precisely controlled by maintaining desired tolerances when the grooves are fabricated during the molding process.

OBJECTS

It is an object of the present invention to provide a connector for supporting a length of conductor in free space, which facilitates ease in assembly of the conductor and the component parts of the connector and which withstands corona and ozone generated by a high voltage elestrostatic charge impressed upon the conductor.

Another object of the present invention is to provide a dielectric connector, which mounts and precisely positions a conductor in free space in such a manner as to provide a uniform electrostatic space charge distributed along a straight length of the conductor, which compensates for dimensional changes in the mounted conductor, which permits connection of the connector to a source of high voltage, which prevents incorrect connection of the connector to a source of high voltage and which is readily assembled from a plurality of interlocking component parts without a need for special tooling.

Another object is to make a connector for high voltage which meets the international safety specifications for creepage and clearance distances.

Other objects and many attendant advantages of the present invention will become apparent from the detailed description taken in conjunction with the accompanying drawings.

BRIEF DESCRIPTION OF THE DRAWINGS

FIG. 3 is a fragmentary elevation in section taken along the line 3—3 of FIG. 2.

FIG. 11 is an enlarged section taken along the line 11—11 of each of FIGS. 10 and 14.

FIG. 12 is an enlarged section taken along the line 12—12 of each of FIGS. 10 and 14.

FIG. 13 is an enlarged section taken along the line 13—13 of each of FIGS. 10 and 14.

DETAILED DESCRIPTION

Figure 1:
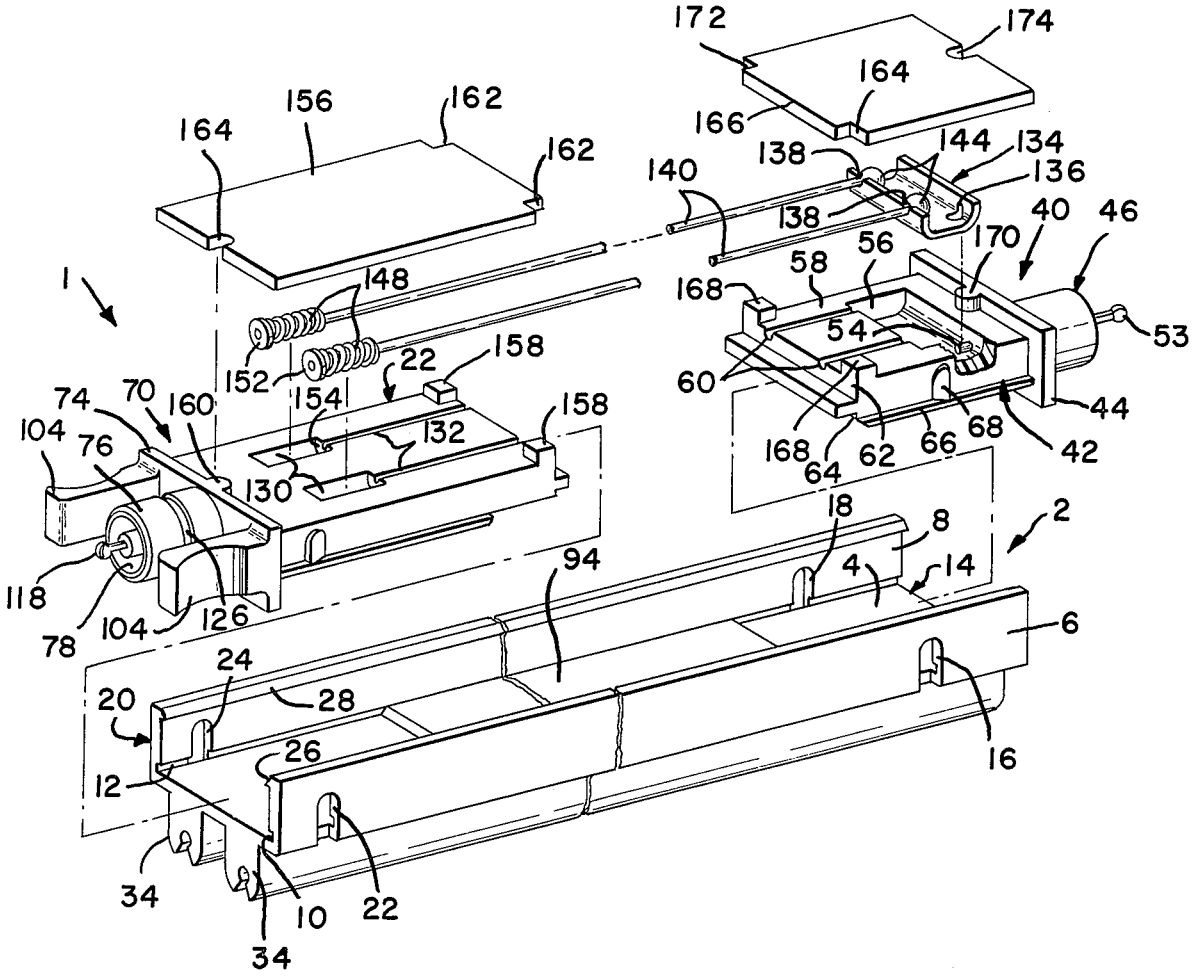
FIG. 1 is a fragmentary perspective with component parts in exploded configuration of a corotron connector according to the present invention.
Figure 5:
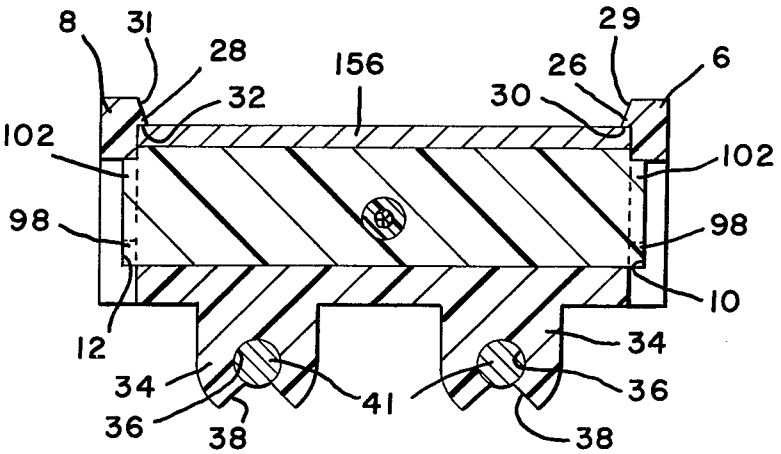
FIG. 5 is a cross-section taken along the line 5—5 of FIG. 2.

With more particular reference to FIG. 1 of the drawings there is illustrated generally at 1 corotron connector according to the present invention. The connector includes a tray shown generally at 2 molded from a dielectric material having a bottom wall 4 and integral side walls 6 and 8 which project outwardly of said bottom wall. The side walls are provided with corresponding inwardly directed grooves 10 and 12, that is, the grooves are internally of the channel and face toward an opposite side of the channel. Additionally the grooves are flush with the bottom wall 4 and are in mutual alignment. An inboard end of the tray is shown generally at 14. Spaced from the inboard end of the tray the side walls are provided with corresponding cutouts or openings 16 and 18 which are arch shaped and which communicate the interior of the tray with the exterior thereof. In similar fashion there is shown generally at 20 an outboard end of the tray having adjacent spaced cutout portions 22 and 24 in the corresponding side walls 6 and 8. The cutouts 22 and 24 are also arch shaped and communicate the interior of the tray with the exterior thereof. The top longitudinal edges of the side walls 6 and 8 are provided with corresponding inwardly directed and projecting lip portions 26 and 28. As shown in FIG. 5, the lip 26 is tapered along its top surface 29 toward the top edge of the channel 6, and the underside 30 of the lip 26 forms an inverted angled shoulder. The lip 26 similarly has a top surface 31 which tapers toward the top surface of the side wall 8 and an inverted angled shoulder 32. Also shown in FIGS. 1 and 5 the bottom wall 4 is provided with integral depending identical standoffs 34. The standoffs or feet 34 extend the entire length of the bottom wall and are molded with inverted elongate recesses 36 having flared entrance openings 38, adapted for receiving therein supporting rods 41. The feet 34 slide over and partially encircle the supporting rods 41, which form no part of the present invention, but which are provided in a duplicating apparatus specifically for the purpose of mounting a corotron.

Figure 4:
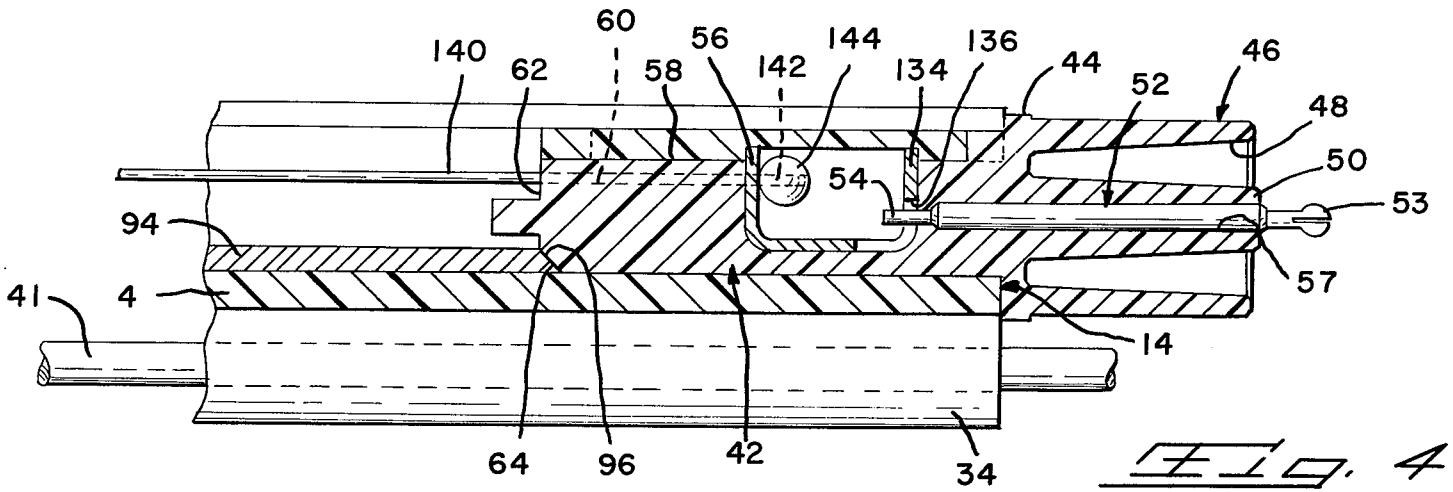
FIG. 4 is a fragmentary elevation in section taken along the line 4—4 of FIG. 2.
Figure 7:
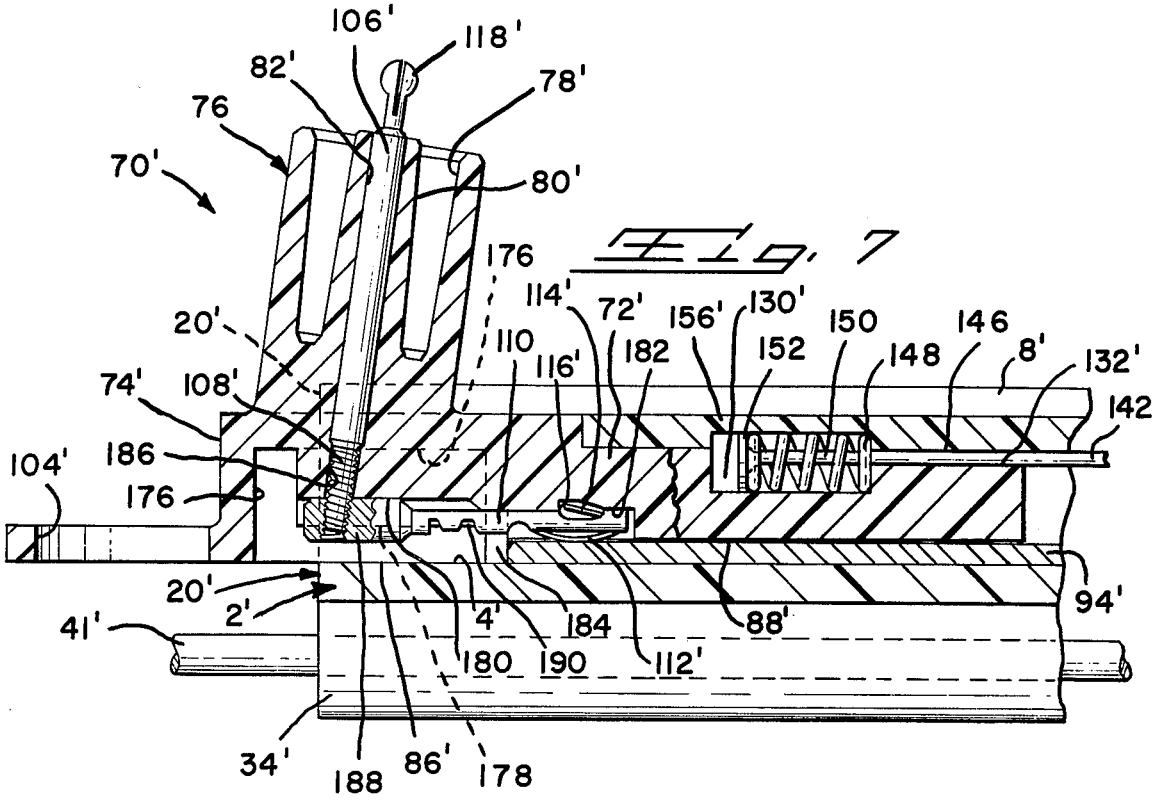
Figure 8:
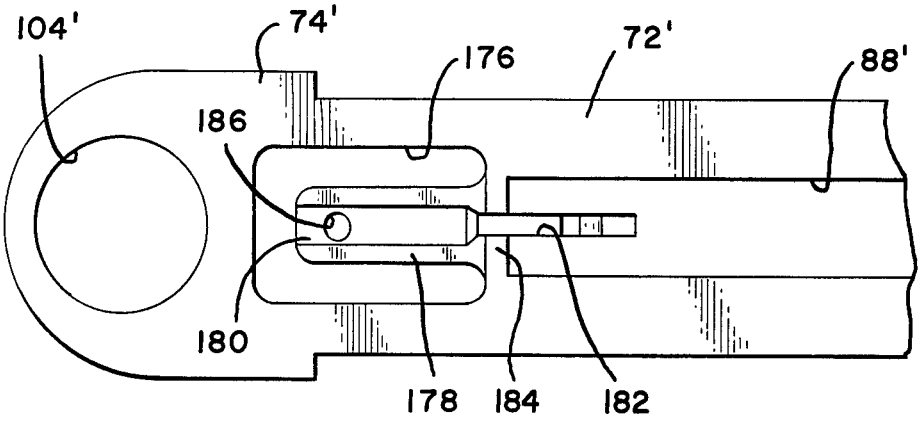
FIG. 8 is a bottom plan view of a portion of the embodiment shown in FIG. 7.

The inboard end 14 of the corotron connector is provided with an inboard end block illustrated in FIGS. 1 and 4 generally at 40. The block 40 is of unitary molded dielectric construction and includes a body portion 42 intersecting at a right angle an integral enlarged end plate or end wall 44. Integral with the wall 44 and outwardly projecting therefrom is a generally cylindrical bushing 46 of an electrical connector. The bushing 46 is shown more specifically in FIG. 4 as being generally hollow at 48 and having an integral and concentric frusto-conical dielectric sleeve 50 which encircles and supports an electrically conducting pin or post 52. The post or pin 52 has a bulbous bifurcated knob 53 which projects outwardly of the sleeve 50 for pluggable connection to a source of high voltage (forming no part of the present invention).

Figure 2:
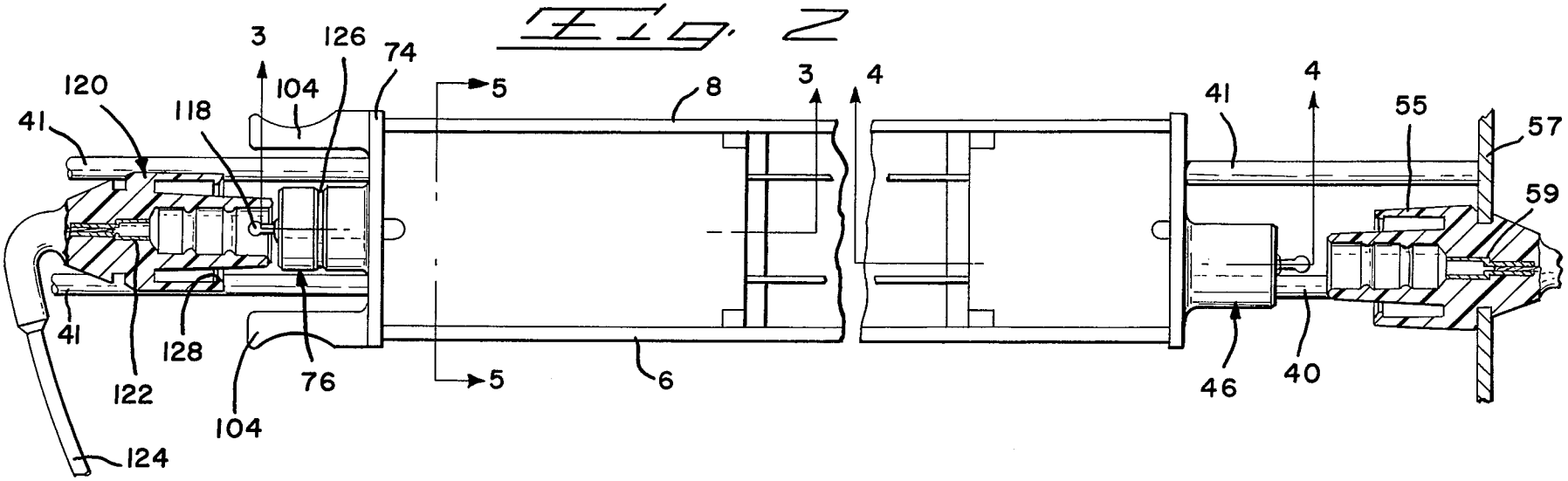
FIG. 2 is a plan view of the connector illustrated in FIG. 1.

The bushing 46 operates as an electrical plug which is connected pluggably to an electrical socket 55 (FIG. 2) of dielectric material mounted on a case 57 of a high voltage source. The socket 55 is configured of silicone, an elastomeric capable of withstanding high voltage, with a plurality of concentric dielectric cups to interfit with the concentric sleeve configuration of the bushing 46. A conducting receptacle contact 59 within the socket matingly receives the knob 53 to establish an electrical connection. The receptacle 59 is electrically connected to a source of high voltage within the case 57. A typical electrical connection of a bushing and socket is disclosed in U.S. Pat. No. 3,871,735; and is adaptable for use in the present invention. The dielectrics and the creepage and clearance distances were tested and found to comply with the international safety standards.

The other end 54 of the pin 52 is of reduced diameter and projects into an enlarged recess 56 provided in the top surface 58 of the body portion 42. The recess 56 is generally of U-shaped cross-section and is purposely made to be top-accessible in respect to the block 40 for a purpose to be described. It is understood that the pin 52 may be embedded in place within the sleeve 50 during fabrication of the dielectric end block by molding. Alternatively the pin may be inserted into a molded through cavity 57 of the sleeve 50. The top surface 58 is further provided with one or more, in this case a pair, of elongate and substantially recessed straight grooves 60 which communicate with the recess 56 and extend to an end surface 62 of the inboard end block 40. The bottom of the surface 62 is recessed by a chamfer 64 for a purpose to be explained hereinafter. The sides of the body portion 52 which are shown as extending between the end surface 62 and the end plate 44 are provided with outwardly projecting longitudinal splines 66 integral with the body portion 42 and so constructed and arranged as to slidably interfit within corresponding grooves 10 and 12 in the tray side walls 6 and 8. In addition the body sides are provided with integral and outwardly projecting arch shaped lugs 68 which are adapted for latchable receipt into the complementary shaped recesses 16 and 18 of the side walls 6 and 8 thereby to retain the inboard end block 40 in desired assembled position within the inboard end 14 of the tray 2. As shown in FIG. 4 the end plate 44 will impinge against and bridge between the ends of the side walls 6 and 8 thereby enclosing and covering the open inboard end 14 of the tray when the end block 40 is latchably engaged in assembled position.

As shown in FIGS. 1 and 3, an outboard end block 70 will be described in detail. The outboard end block is of unitary dielectric molded construction and includes an enlarged body portion 72 which is generally rectangular and is adapted to be inserted into the outboard end 20 of the channel shaped tray 2. The body portion 72 intersects at a right angle an integral and generally rectangular end wall or end plate 74. Integral with and projecting outwardly from the end wall 74 is a generally cylindrical bushing 76 of an electrical connector which has a hollow interior 78 and an integral concentric frusto-conical sleeve 80. The sleeve 80 has a concentric internal cylindrical cavity 82 extending through the sleeve and the body portion 72, terminating just short of an end 84 of the block. Adjacent the intersection of the end 84 and a bottom surface 86 of the body portion 72 the end block 70 is undercut or provided with a recess 88 which communicates with the generally cylindrical cavity 82. The undercut recess terminates in a chamfer 90 adjacent to the bottom surface 86. As shown more particularly in FIGS. 1, 3 and 4 when the end block 70 is properly positioned in the outboard end 20 of the chamfer 90 engages a complementary chamfered wall 92 of a electrically conducting metal plate conductor 94. The plate conductor 94 is retained in and conforms to the shape of the recess 88. The opposite end 96 of the plate conductor 94 is of a configuration complementary to the chamfer portion 64. In this case it also is chamfered to engage the complementary chamfered configuration 64 of the wall portion 64. The plate conductor 94 is thereby sandwiched between the inboard and outboard end blocks 40 and 70, respectively. The plate conductor 94 further is of a thickness so as to interfit, and thereby captivated, within the aligned grooves 10 and 12 of the side walls 6 and 8 respectively. Accordingly, the plate conductor 94 is readily assembled to the tray merely by inserting it within the complementary grooves 10 and 12 and sliding it into position along the tray. Subsequently the assembly of the end blocks 40 and 70 within the ends of the tray will sandwich the plate therebetween and thereby locate the tray correctly in position along the bottom wall 4.

Again with reference to FIGS. 1 and 3, the outboard end block 70 includes side keys or splines 98 molded integral with and extending along the body portion 72 for complementary sliding receipt in corresponding grooves 10 and 12 of the side walls 6 and 8, respectively. The keys 98 laterally project from the sides 100 of the body portion 72 and terminate adjacent to the chamfered wall 90. Additionally the sides 100 are provided with a corresponding integral and outwardly projecting arch shaped lugs 102 which latchably interlock within corresponding recesses 22 and 24 upon insertion of the end block 70 within the end 20 of the tray 2. The lugs 102 thereby latch the block 70 correctly in position within the end 20 of the tray. When correctly in position the end plate or wall 74 of the end block 70 will bridge across and engage the ends of the side walls 6 and 8 and thereby cover the otherwise open end 20 of the tray 2.

The end wall 74 is shown in FIG. 1 as having an integral outwardly projecting pair of handles 104 which are oppositely bowed and spaced on opposite sides of the bushing 76 a distance sufficient to allow gripping between thumb and foreginger by a user of the corotron connector. The handles 104 are conveniently and safely provided only in the outboard end 20 of the corotron connector as far away as possible from the inboard end 14 adapted for connection to a source of high voltage. The bushing 76 is adapted for connection to the electrical bias voltage for the corotron which is not shown and which forms no part of the invention. Grasping the bushing 76 would not be dangerous to a user of the corotron connector. However, under ordinary use the bushing 76 is not properly identified as being electrically safe. It is then not a good practice to allow a user to grasp the bushing 76. The presence of handles 104 thus deter careless practice of handling the bushing which is not identified to be electrically safe. The handles 104 also project outwardly past the end of the bushing 76 to stop any attempt to pluggably connect the bushing 76 to a source of high voltage.

To provide for electrical connection of the bushing 76 to electrical bias voltage of a duplicating machine utilizing the corotron there is provided an elongated conducting rod 106 insertable along the cavity 82. One end 108 of the rod is of reduced configuration and has electrically secured thereon a barrel shaped electrical contact 110. The contact 110 is secured to the conductor end 108 by crimping or any other suitable electrical fastening technique. The contact 110 is provided with a resilient leaf spring 112 which resiliently engages the plate conductor 94. A projecting finger or lance 114 of the contact 110 latchably engages in a recess 116 molded into the body portion 72 adjacent the end of the cavity 82. According to usual practice, the contact 110 and the conductor 108 are secured together and then are freely inserted along the cavity 82 until the lance 114 springs outwardly into place within the cavity 116 to prevent withdrawal of the contact 110 and the conductor 106 from the cavity 82. The conductor has an opposite end 118 which terminates in a bulbous knob bifurcated and providing a male electrical contact of an electrical plug. An examplary socket is shown generally at 120 in FIG. 2. The socket is comprised of molded silicone a soft and relatively pliable elastomer configured in a shape having a plurality of concentric cups so as to interfit with the concentric sleeve configuration of the bushing 76. The innermost concentric cup has a substantially recessed electrically conducting socket 122 which is adapted to compressibly receive the bifurcated knob 118 therein to establish a removably pluggable electrical connection. This connection was tested and found to comply with the before mentioned international safety specifications. The receptacle 122 is electrically connected to an insulation covered high voltage wire 124 connected to electrical shielding or source of bias voltage of the copying machine utilizing the corotron connector. The bushing 72 is provided with a circular groove 126 in its cylindrical outer periphery to receive therein a complementary configured inwardly directed lip 128 of the socket as a visual indication that the socket 120 is fully inserted into pluggable electrical connection with the knob 118 and the bushing 76. Silicone is selected as a good dielectric since it conforms to the shape of the bushing 76, is able to withstand corona and ozone generation and also provides a good environmental seal around the bushing.

Figure 6:
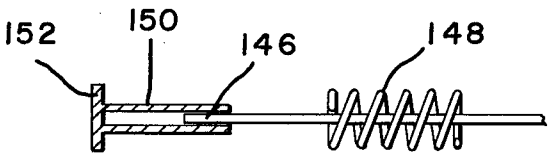
FIG. 6 is a fragmentary elevation of the spring connection with parts in section and with parts in exploded configuration.

With more particular reference to FIGS. 1 and 3, the body portion 72 of the outboard end block 70 has its top surface provided with one or more, in this case a pair, of spaced generally cylindrical recesses 130. A corresponding number of straight grooves 132 in the top surface extend and communicate with the recesses 130 and extend from the recesses 130 to the end 84 of the body portion 72. The grooves 132 are in alignment with the grooves 60 of the inboard end block 40. As shown in FIGS. 1 and 4, an elongate plate contact formed into a generally U-shape is shown at 134. It has a slot 136 provided therein of a width to grip on the end 54 of the conductor 52 when the plate conductor 134 is readily inserted into the top-accessible recess 56 of the end block 40. The slot 136 faces in a downward direction generally such that assembly of the plate conductor 134 in the recess 56 simultaneously forces the conductor end 54 to be grippingly received within the confines of the slot 136 to establish an electrical connection thereby. A top edge of the U-shaped plate contact 134 is provided with a pair of generally narrow notches 138 which are in alignment with the grooves 60 of the end block 40. As shown in FIG. 1, one or more, in this case a pair, of elongate electrical wires or conductors 140 which are to be impressed with a high voltage electrostatic charge are adapted to register within the notches 138. More specifically, FIG. 4 illustrates that each conductor 140 has one end 142 attached to a conductive ball 144. Each ball 144 typically is provided with a groove therein (not shown) which receives the end 142 of a conductor 140. Then the ball 144 is compressed to close the groove and pinch the conductor thereby providing a secure connection of the ball to the conductor 142. Subsequently each conductor 140 is inserted into a corresponding notch 138 of the plate conductor 134. Each conductor is more or less freely received in a corresponding notch. The ball 144 of each conductor will be located within the U-shaped confines of the plate conductor 134. Each conductor 140 has an opposite end shown at 146 in FIG. 6. A length of coil spring 148 having square ends is slipped over each wire end 146, and a sleeve 150 having an enlarged circular head 152 is crimped onto the end 146, the head thereby preventing removal of the spring 148 which encircles the wire. As shown in FIG. 1, the spring 148 and the sleeve 150 are readily inserted into a top-accessible recess or cavity 130 of the outboard end block 70. The conductors 140 will be readily recessed into the top-accessible grooves 132. The springs 148 also will be partially compressed between the sleeve head 152 and an appropriate end wall 154 of the recess or cavity 130 thereby applying tension to the corresponding conductor 140. It is readily seen that the balls 144 will resist the tension on the wires 140 and will also electrically impinge or engage against the plate contact 134. Again as shown in FIG. 1 a dielectric cover plate 156 is adapted to seat against the top surface of the body portion 72. Upstanding and integral projecting rectangular projections 158 at the corners of the body portion, together with a generally arcuate projection 160 integral with the end plate 74 interfit within corresponding and complementary configured notches 162 and 164 of the cover plate thereby correctly orienting the cover plate on the body portion 72. Retaining the cover plate 156 latchably in place will be described by reference to FIG. 5 wherein the cover plate 156 is shown latchably confined under the projecting lips 26 and 28 of the tray side walls 6 and 8. The walls 6 and 8 can withstand an amount of resilient deformation sufficient to allow forcible insertion of the cover 156 past the lips and into latched engagement under the inverted angled shoulder portions 30 and 32 whereby the cover is readily assembled in place without the need for complicated tooling. The cover thereby encloses or covers the springs 148, the sleeves 150 and the end portions 146 of the wires preventing removal thereof from the end block 70. In similar fashion a cover plate 158 is provided to overlie the top surface 58 of the end block 40. The end block 40 also is provided with generally rectangular and integral corner projections 160 and an arcuate projection 162 adjacent to and integral with the end plate 44. Such projections interfit with corresponding and complimentary configured notches 164 and 166 of the cover plate 158 to correctly orient the cover plate 158 in place on the block 40. The cover plate similarly as in the case of the cover plate 156 is latchably secured under the lips 26 and 28 and captivated in place by the shoulder portions 30 and 32. The plate contact 134, the ball 144 and the ends 142 of the conductors wires 140 and thereby retained in the end block. Whereas in the finished assembly the coil springs 148 apply tension to the wires readily upon their compression and assembly within the recesses 130 this eliminates the need for gauging the tension and also trying to fasten the wires while maintaining tension thereon. The coil springs also provide floating connections for the wire which expand and contract in response to expansion and contraction of the wires. This insures the maintenance of tension on the wires without causing or allowing distortion of the wires. Substantial lengths of the wires 104 are straightened and supported against the grooves 132 and the grooves 60. By controlling the tolerances and the location of the grooves during molding this also precisely controls the positioning of the wires 140 in free space between the end blocks 40 and 70. It is important to maintain the free space length of the conductors precisely straight and in precise alignment and location so as to achieve consistent and distortion free space charge around the wires and along the lengths of the wires in free space. Thus positioning of the wires is readily accomplished by the structure described without a need for special tooling or complicated assembly procedures.

The assembly of the corotron will be summarized as follows. The end blocks 40 and 70 are provided with their corresponding conductors 52 and 106. The plate conductor 94 is captivated within the grooves 10 and 12 of the tray side walls 6 and 8. The end blocks 40 and 70 are then assembled into corresponding open ends 14 and 20 of the tray 2 and are latched into position thereby sandwiching and correctly positioning the plate conductor 94. The plate contact 134 is inserted within the corresponding recess 56 of the end block 40 simultaneously making electrical connection to the end 54 of the conductor 52. The conductor wires 140 are provided thereover with the coil springs 148 and are connected at their ends to the corresponding sleeves 150 and balls 144. Then the wires 140 are laid within the grooves 132 and 60. The balls 144 are located in place within the confines of plate contact 134 and the conductors are inserted into the notches 138. The springs are then inserted with the corresponding recesses or cavities 130 thereby placing the wires 140 in tension and impinging the balls 144 against the contact plate 134. Then finally the cover plates 156 and 166 are assembled over the corresponding blocks 70 and 40. The user of the fully assembled corotron then positions the feet 34 over the rod configured rails 41 and, grasping the handles 104, slidably urges the corotron connector along the rails to pluggably connect the bushing 46 in the socket 55 of the source of high voltage. In so doing the user is adequately isolated from the source of high voltage and is not required to visualize or handle the inboard end of the corotron connector when connecting the corotron connector to the high voltage. The socket 120 is then secured on the bushing 76 whereby electrical connection of the bias voltage is safely accomplished along the conductor 106 to the plate conductor 94. Accordingly the plate conductor 94 is connected to the conductor 106 and the socket 120 and then to the electrical shielding of a copying or duplicating machine utilizing the corotron conductor.

Figure 7:
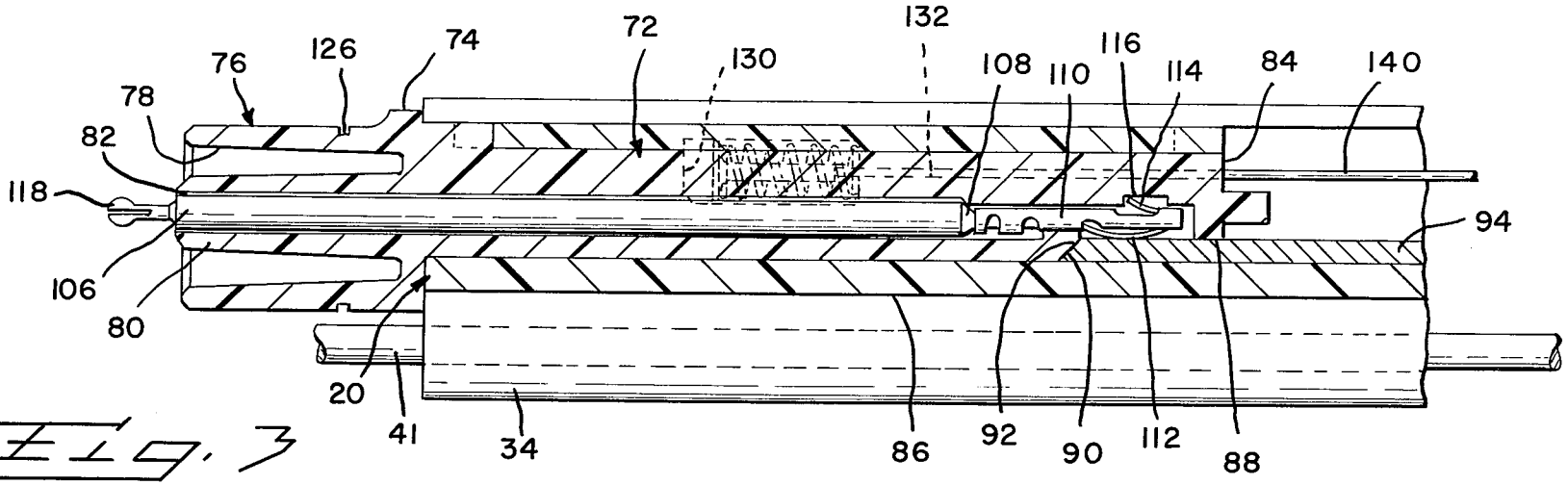
FIG. 7 is an enlarged fragmentary elevation in section illustrating another preferred embodiment.

As shown more particularly in FIG. 7 a modified outboard end block 70' will be described in detail. Like numerals will designate like parts in respect to the outboard end block 70 previously described. The modified outboard end block includes an enlarged body portion 72' which is generally rectangular and is adapted to be inserted into outboard end 20' of the channel shaped tray 2' similar to the channel shaped tray 2. Integral with the body portion 70' is an enlarged end wall 74' in the form of a large block or thick plate bridging across and covering the end 20' of the tray 2'. Integral with and projecting outward from the intersection of the end wall 74' and the body portion 72' is a generally cylindrical bushing 76' of an electrical connector similar to the bushing 76. More particularly the bushing has a hollow interior 78' and an integral concentric frusto-conical sleeve 80'. The sleeve 80' has a concentric internal cylindrical cavity 82' extending through the sleeve and the body portion 72' at an angle of 82° with respect to the bottom wall 4' of the tray 2'. The bottom surface 86' of the block 70' is undercut or provided with a recess 88' receiving therein a metal plate conductor 94' similar to the conductor 94 previously described. Interfitting the end block 70' into the tray 2' is accomplished in the same manner as described with reference to interfitting the block 70 in the tray 2. The block 70' further is provided with an integral apertured flange 104' integral with the end wall 74' serving as a handle similar in function to the pair of handles 104 previously described. The apertured flange as shown is generally in the form of a ring integral with the end block 70'.

The block 70' further is provided with an inverted and relatively deep U-shaped recess 176 which bridges across the intersection of the body portion 72' and the end wall 74'. The U-shaped recess partially encircles a land or boss 178 which is provided with a stepped generally arcuate groove 180 extending into a reduced diameter groove 182 communicating with the recess 88'. It is noted that there is a thin web or wall 184 separating the recess 88' from the land 178. To provide for electrical connection of the bushing 76' to an electrical bias voltage there is provided an elongated conductor rod 106' insertable along the cavity 82'. One end 108' of the rod is of reduced configuration and is threaded and projects through a reduced aperture 186 in alignment with the aperture 82'. The rod 106' is rotatably received in the bushing and seats against the bottom of the aperture 82'. The threaded end 108' protrudes from the aperture 186 and is threadably secured to a generally cylindrical link 188 seated within the recess 180. The link 188 has a reduced integral portion 190 on which is electrically secured by crimping a contact 110', similar to the contact 110 and provided with a resilient leaf spring 112' which resiliently engages the plate conductor 94'. A projecting finger or lance 114' of the contact 110' latchably engages in a recess 116' molded into the body portion 72' adjacent the end of the cavity or groove 182. Threadable attachment of the rod 106' is readily accomplished by rotating the rod by the projecting end 118'. Then a quantity of sealant such as RTV silicone plugs the opening caused by groove 182 through the web 184. Sealant is also applied in the aperture 186 prior to threaded assembly of the link 188. Upon curing the sealant forms a barrier to stop the flow of dielectric encapsulant such at RTV silicone added to and completely filling the recess 176 and the groove 180 surrounding the link 188 and the portion of the contact 110' projecting past the web 184 into the groove 180. The exemplary socket 120 or one similar thereto may be electrically connected to the bushing 76' establishing a removably pluggable electrical connection to electrical shielding or bias voltage of the copy machine utilizing the corotron connector. The body portion 72' is provided with one or more generally cylindrical recesses 130' and a corresponding one or more grooves 132' communicating with the corresponding recesses 130'. As previously described a conductor 142, the end 146 of which is provided thereover with a coil spring 148, and the sleeve 150, with the enlarged head 152 thereof, are received within a corresponding recess 130'. A cover plate 156' covers the assembly to retain the wire end, the coil spring and the sleeve in place.

Another preferred embodiment is shown in FIGS. 9–19. This embodiment provides multiple elongate conductors and multiple plate conductors operating at different voltages. All electrical connections are made at the inboard end of the corotron, utilizing H.V. bushings which are readily plugged or unplugged as desired. Special precautions are necessary to provide lengthy surface and air gap tracking thereby to prevent voltage shorting or shock hazards. Simultaneously low cost fabrication and minimum use of materials are required.

The standard practice in molding has been to avoid making complex structures in a single piece. Such a practice has eliminated experimentation in the construction of molds. Also assembly of the parts has been accomplished with low labor costs. However, in the present invention, high voltage tracking is deemed to occur at the interface between assembled dielectric parts even though the parts are bonded along the interface. Accordingly, the need for eliminating assembly interfaces or making such interfaces with extraordinarily lengthy tracking paths must be done to meet international standards for creepage and clearances. As operating voltages increase or are combined to operate at different levels in a single corotron, considerable demands are placed upon design and fabrication for operation with adequate voltage safeguards. Considerable redesign and experimentation is required, to result in a corotron which will operate with designed safety and operativeness.

In the embodiment shown in FIGS. 9–19, the above considerations require the corotron conductors to be separated from each another and from other surfaces of the corotron which are desired to be isolated or protected from high voltage by lengthy surface and air gap tracking paths, more commonly called creepages and clearances. For example, the plate conductors are individually disposed in dielectric channels having integral sidewalls that provide lengthy surface and air gap tracking separation. The sidewalls are of thin molded sections to minimize material consumption, and while intricate and difficult to mold, provide compact and lengthy circuituous surface tracking paths. Repetitive thin wall sections throughout the corotron may be tailored for a variety of functions. Multiple portions of the corotron can be molded as one piece if interconnected by thin wall sections. Material mass is held to a minimum and creepage and clearance requirements are met without bulk. Where thick wall sections are required for strength or for other purposes separate parts may be constructed. For example, the end block which is provided with the electrical bushings 46 and 76 requires relatively thick molded sections for strength and for embodying irregular mold configurations which accommodate the electrical interconnections between the bushings and the respective conductors. However, upon assembly of the separate parts, such as the end block and the tray, the interfaces of the separate parts provide voltage tracking paths, requiring special precautions to provide for adequate creepages and clearances.

Figure 9:
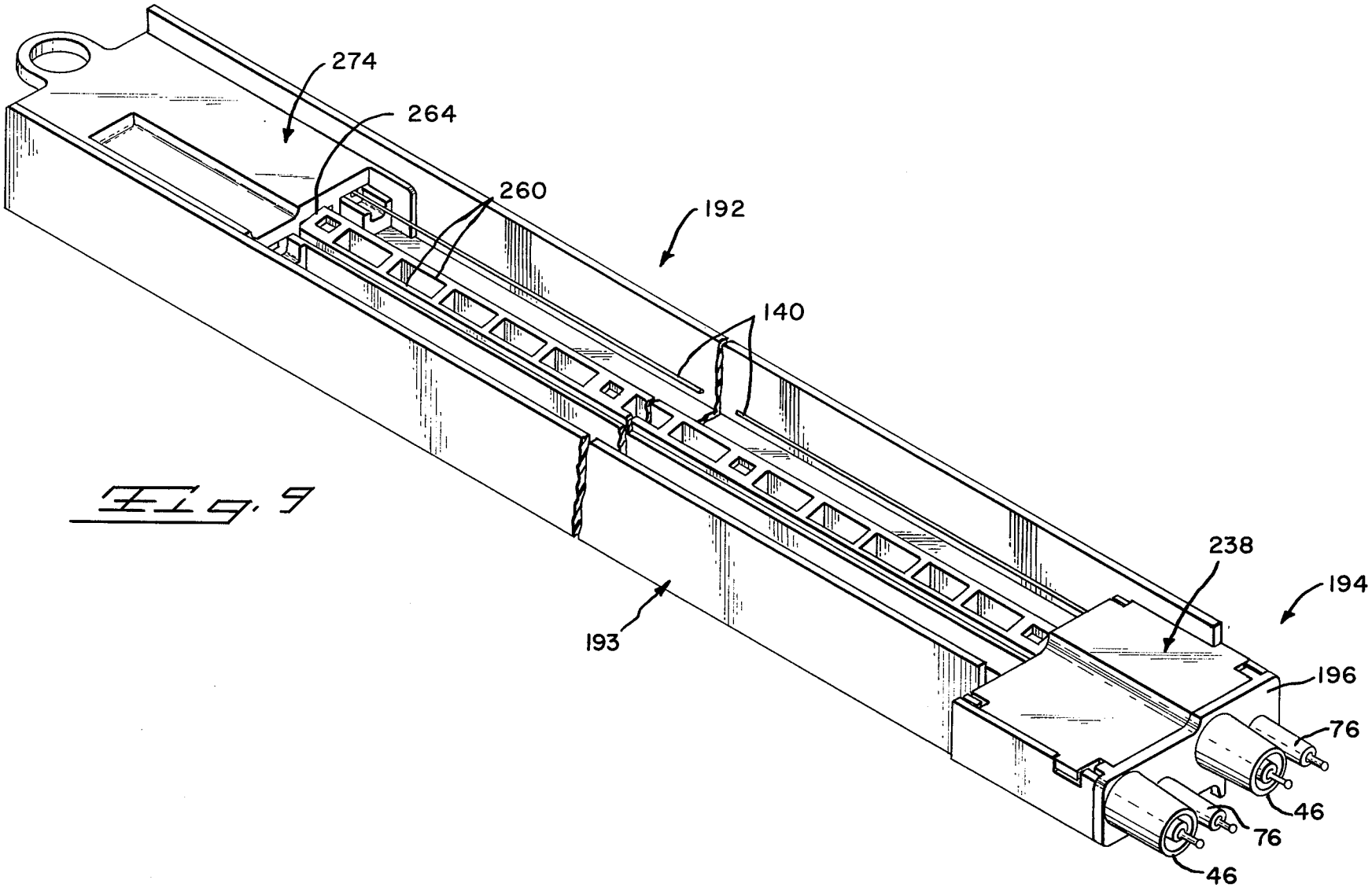
FIG. 9 is a perspective of another preferred embodiment of a corotron connector according to the present invention.
Figure 10:
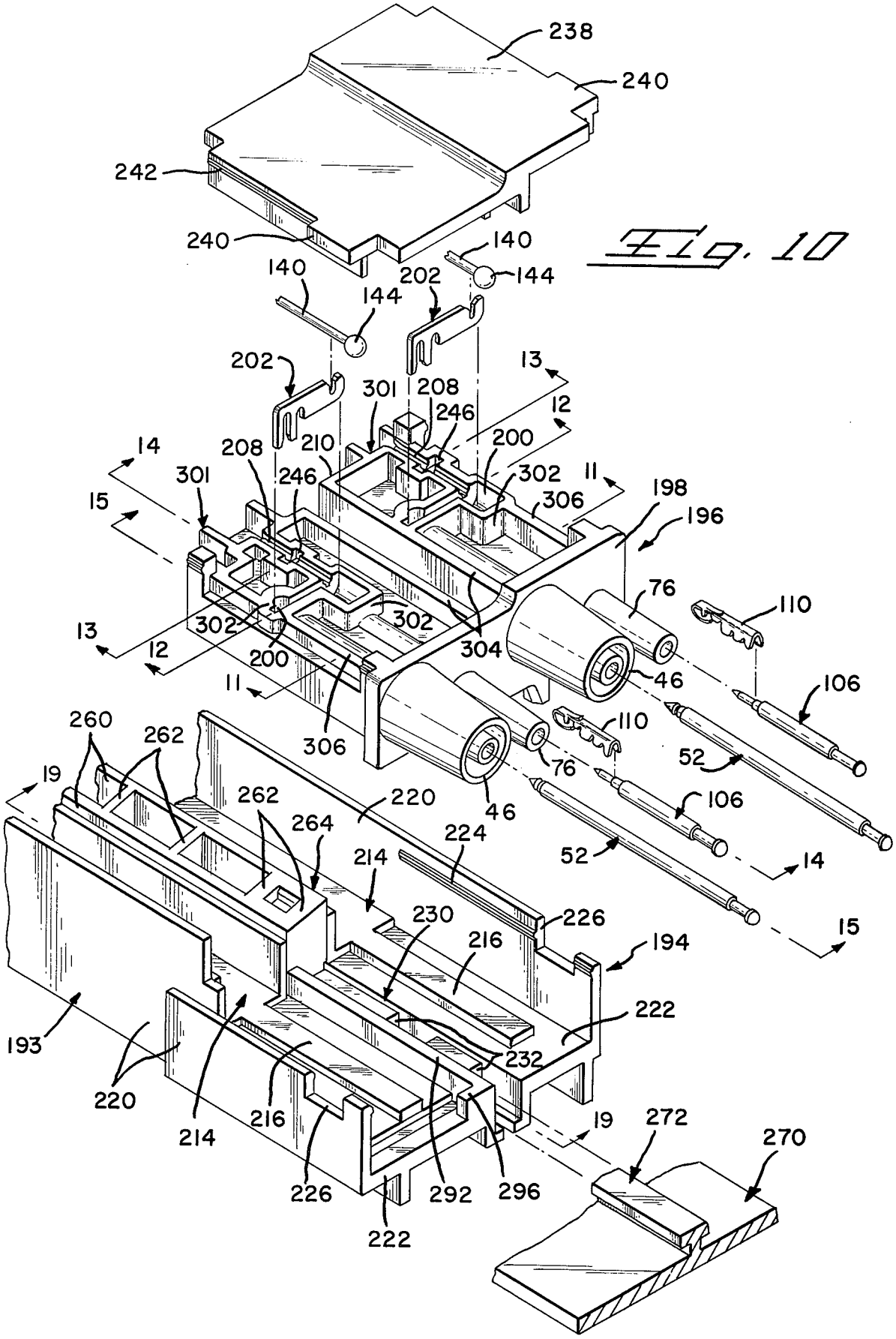
FIG. 10 is an enlarged fragmentary perspective of an inboard end of the corotron connector of FIG. 9, with parts in exploded configuration.
Figure 14:
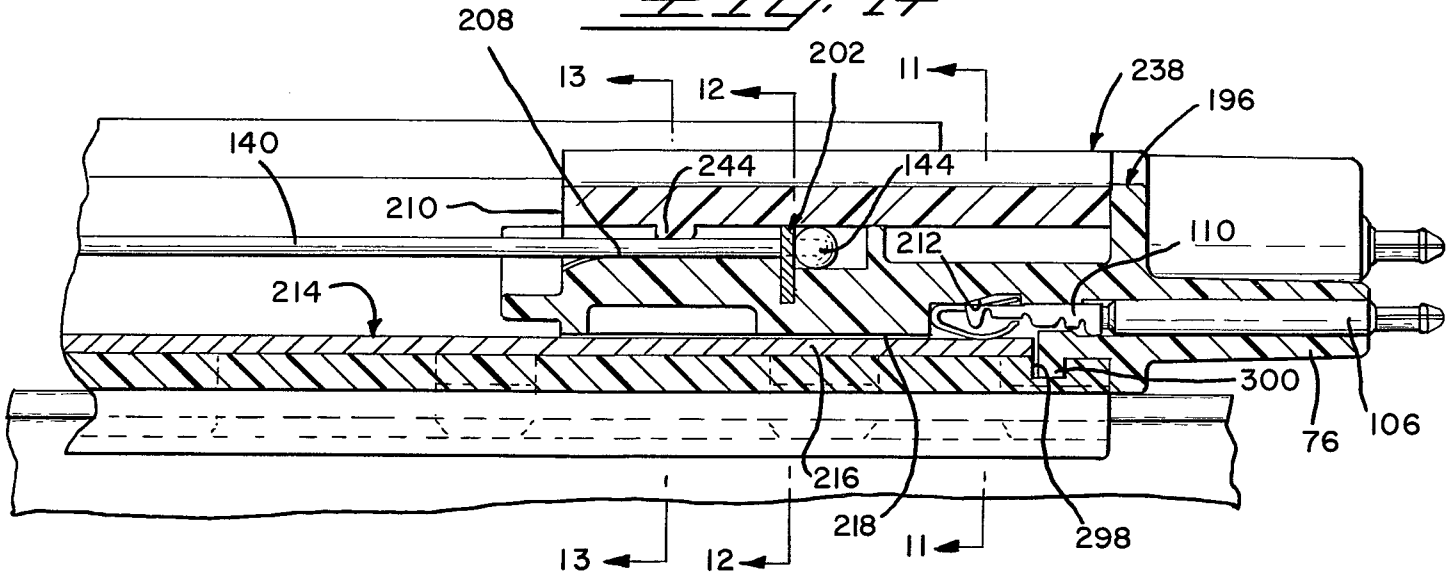
FIG. 14 is an enlarged fragmentary section taken along the line 14—14 of FIG. 10.

Accordingly, another preferred embodiment of a corotron is shown generally at 192 in FIGS. 9–11. A molded dielectric tray is shown generally at 193. As shown in FIG. 10, the inboard end 194 of the tray is open. A separate molded dielectric end block 196 includes an enlarged integral end plate 198 which covers the open end of the tray when the block 196 is assembled therewith. All electrical connections of the corotron to external voltage sources are accomplished at this inboard end 193. Thus a plurality of dielectric bushings 46 and 76, similar to those of the previously disclosed embodiments, are provided integral with and projecting from the end plate 198. Conductor means in the form of elongate conducting pins 52 and rods 106 similar to the pins and rods of the previously disclosed embodiments are mounted in corresponding bushings. The pins and rods are exposed by the bushings for connection to corresponding voltage sources and project inwardly of the block 196. By referring to FIGS. 10, 11, 12 and 15 the pins 52 project through corresponding bushings 46 and end plate 198 and into corresponding contact receiving recesses 200. The recesses 200 are shown more particularly in FIG. 10 as being vertically recessed in the top of the block. Notched plate type electrical conductive contacts 202 are received in the top accessible recesses 200. Similarly as the contacts 134, contacts 202 includes inverted notches 204 which wedgingly receive and resiliently grip the pins 52. The contacts 202 further include notches 206 which receive portions of elongate conductors 140, with the attached conductor balls 144, as in the previous embodiment, engaging the contacts 202 and operating to electrically connect the conductors 140 therewith. As shown in FIGS. 13 and 14 the top of the block 196 includes vertically recessed grooves 208 communicating with corresponding recesses 200 and extending to an end 210 of the block which faces into the tray where the block is assembled to the tray. The grooves receive and support end portions of the conductors 140 vertically above the tray.

As shown in FIGS. 12 and 14 the rods 106 project through corresponding bushings 76 and end plate 198, and the corresponding contacts 110 are exposed in undercut recesses 212 for electrically engaging corresponding plate conductors 214. More particularly the plate conductors 214 are shown in FIG. 10 as being of rectangular channel shape having integral tongue portions 216, which are shown in FIGS. 11, 13 and 14 as being disposed in inverted grooves 218. The end block overlies the tongue portions and thereby retains the plate conductors in assembled positions on the tray 194. The plate conductors and the tongue portions thereof are shown as vertically under the conductors 140. As shown in FIGS. 10–15 the block is mounted between vertically projecting sidewalls 220 integral with the tray 193. The block also is supported on a multilevel bottom wall 222 of the tray. The sidewalls 220 are molded with relatively thin projecting ribs 224 interrupted by vertical notches 226 in the sidewalls. The block is provided with similar molded ribs 228 which are forcibly traversed over the sidewall ribs 224 when the block is vertically pressed into mounted position on the bottom wall 222. The ribs 228 will then lie under the ribs 224 to hold the block in position. The mechanical connection which resists pull-out of the block resides in a channel 230 vertically recessed in the bottom wall 222 with spaced molded webs 232 bridging across the channel. The block is provided with depending integral flanges 236 which register in the channel 230 and which are complementary shaped for insertion vertically and for registration between the webs 232 whereby the flanges 236 are lockingly retained between the webs 232. The flanges therfor, rigidify the assembly and prevent the block from either vertical or horizontal displacement.

To complete the end block assembly a plate form, molded dielectric cover 238 is made to overlie the block 196. The cover has horizontally projecting tabs 240 which are received in the sidewall notches 226 to align the cover between the sidewalls 220. The cover also has horizontally projecting ribs 242 which are forced past the sidewall ribs 224 when the cover is vertically forced between the sidewalls 220 during vertical assembly of the cover engageably on the block 196. Once assembled on the block the cover ribs 242 latch under the sidewall ribs 224 and retain the cover firmly in compression on the block. The cover can be removed only by a screwdriver or other instrument inserted into the notches 226 and by prying upwardly the tabs 240 and thereby forcibly unlatching the cover from the sidewall ribs 224. The assembled cover overlies and covers the recesses 200 and grooves 208 as well as the contacts 202 and portions of the conductors 140 which are received in the recesses 200 and grooves 208. As shown in FIG. 13, integral depending tabs 224 on the cover engage and overlie the conductors 140 to hold them in the grooves 208. The grooves include widened portions 246 to receive the tabs 244.

Figure 16:
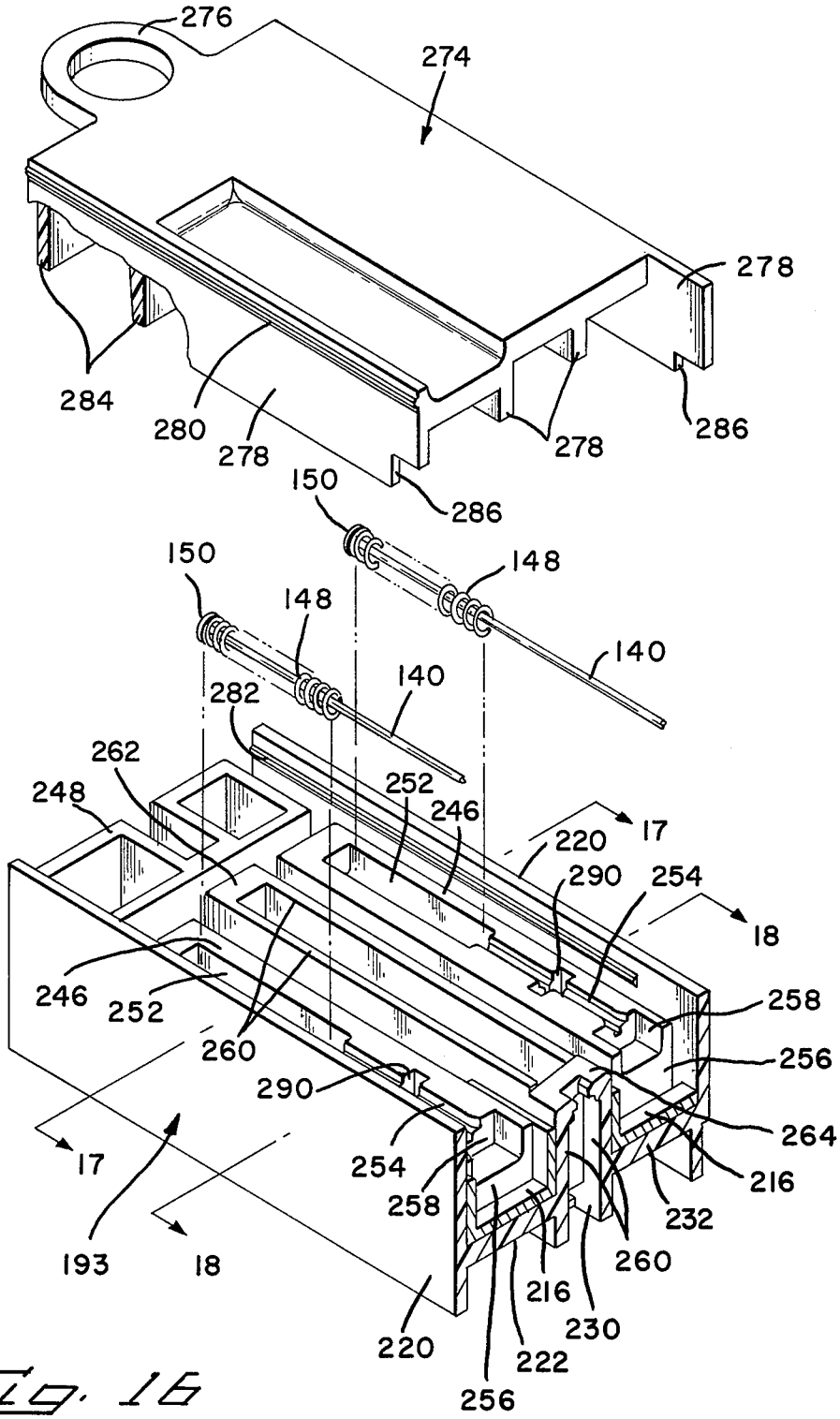
FIG. 16 is an enlarged fragmentary perspective of an outboard end of the corotron connector shown in FIG. 9 with parts in exploded configuration.
Figure 17:
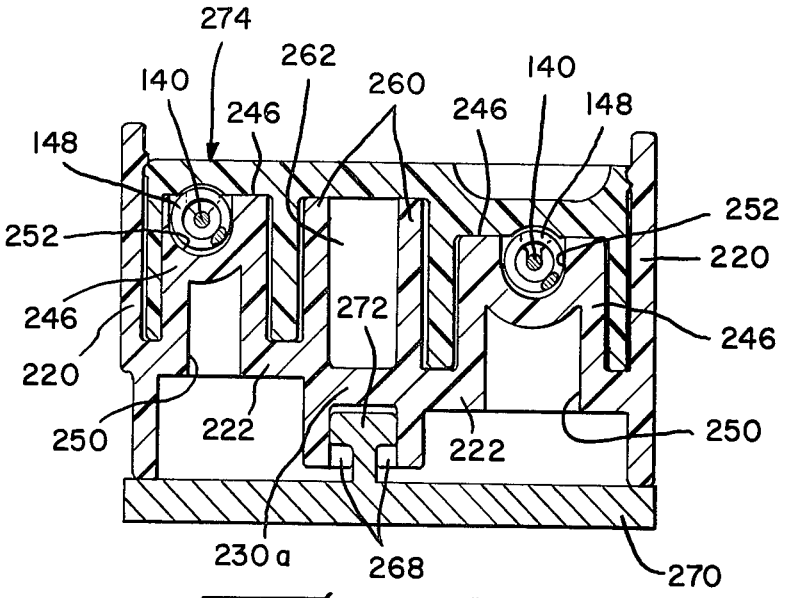
FIG. 17 is an enlarged section taken along the line 17—17 of FIG. 16.
Figure 18:
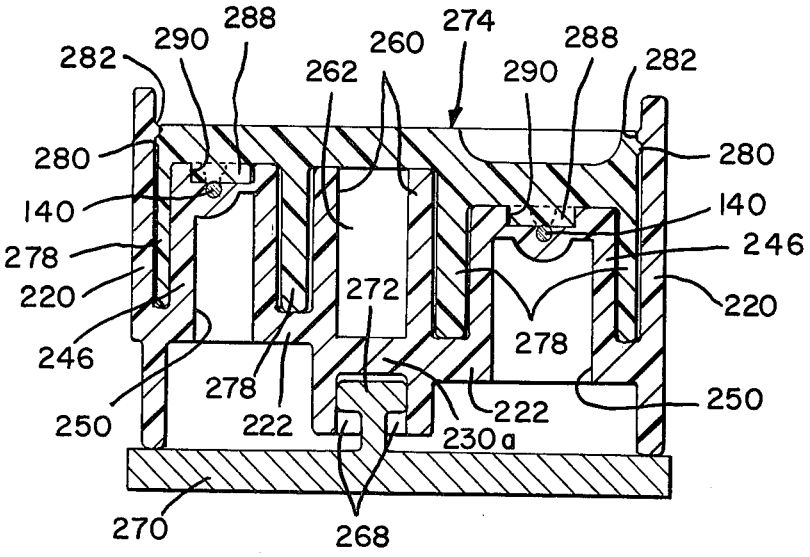
FIG. 18 is an enlarged section taken along the line 18—18 of FIG. 16.

With reference to FIGS. 16–18, the other end of the tray 193 will be described in detail. The major feature these figures illustrate is an end block construction which is integral with the tray 193. More particularly, the bushings at one end only allows the elimination of a removable end block. Instead, the stepped bottom wall 222 of the tray is provided with a plurality of integral vertically projecting pillars 246 and 248. The bottom wall is provided with inverted recesses projecting within the pillars and making them hollow thin section is construction. The tops of the pillars 246 are provided with vertical recesses or cavities 252 having semicircular arch shaped bottom surfaces. Elongate vertically recessed grooves 254 communicate with the cavities 252 and project toward those pillar ends 256 which face inwardly of the tray. The grooves open into enlarged stepped entryways at the ends 256. The ends of the conductors 140 are provided with the conductive sleeves 150 and the springs 148 as in the previously disclosed embodiment. The springs 148 and sleeves 150 together with the end portions of conductors 140 are vertically inserted and thereby received in the cavities 252, with the conductor end portions further being vertically inserted and thereby received in the top accessible grooves 254. The pillars 246 thereby support the end portions of the conductors 140. The conductors 140 thus have their end portions supported by the pillars and the end block and include portions which bridge across the free space between the pillars and the end block. The grooves 254 and 208 precisely align the conductors 140 within the free space which also is disposed along the tray between the sidewall 220.

The pillars 246 and 248 are separated by a pair of spaced vertical thin section partitions 260 which are molded integral with the bottom wall 222 of the tray 193 projecting parallel to the sidewalls 220 of the tray. As shown in FIGS. 9, 10 and 16, the partitions 260 are separated by the channel 230 which projects for a substantial length along the tray 193. The partitions 260 are on either side of the channel and are cross connected with a plurality of integral thin section webs 262.

The first and last webs form solid end walls connecting across the ends of the partitions 260. The tops of the partitions and the tops of several of the webs 262 which are disposed in the space between the partitions 246 and end block 196 are beveled as shown at 264 to provide a beveled bearing surface, on which a copier machine component or device (not disclosed) may be mounted, or on which the corotron provides a stand-off for itself when mounting the corotron to a copier machine component or device (not disclosed).

Figure 19:
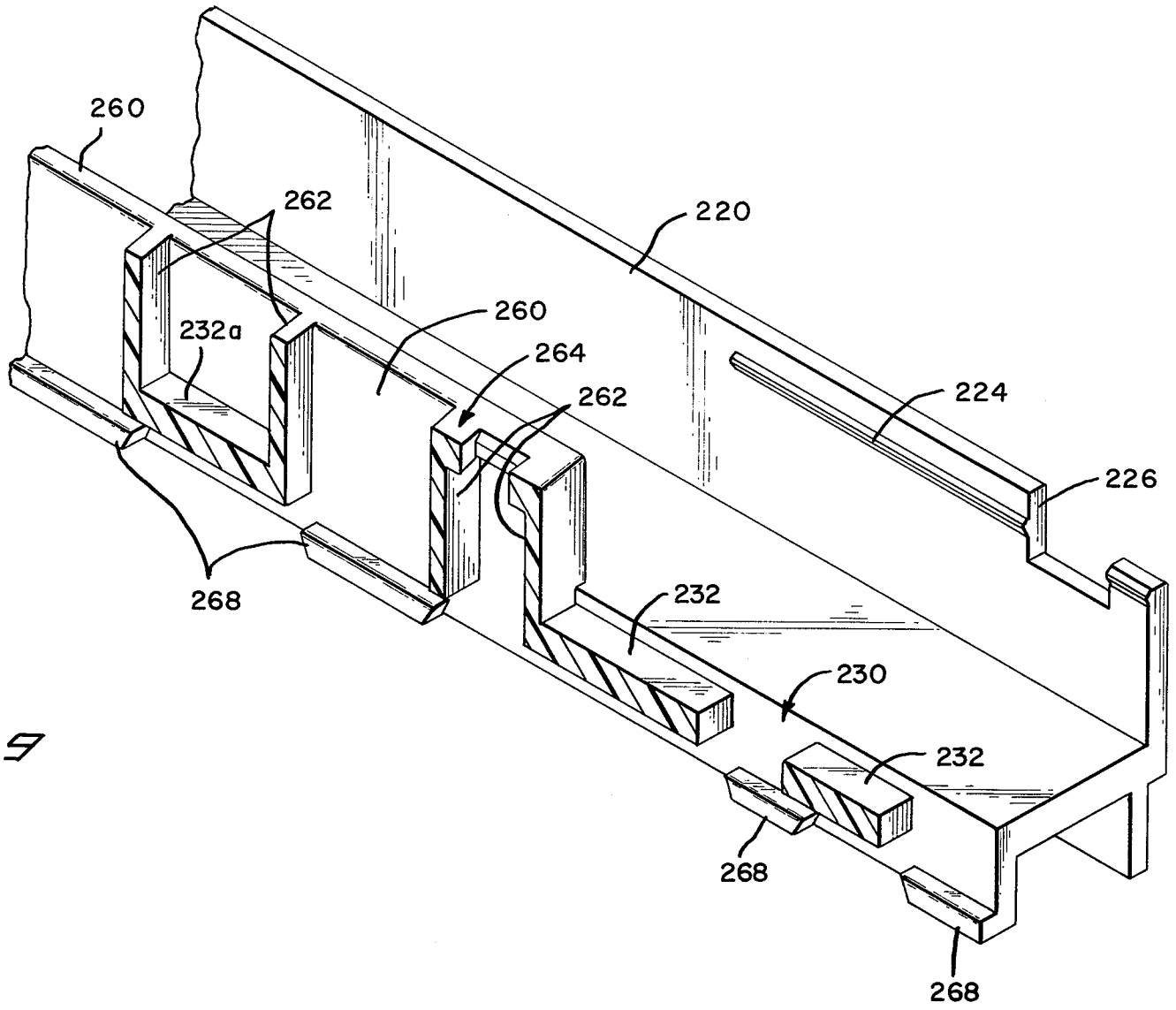
FIG. 19 is an enlarged fragmentary section taken along the line 19—19 of FIG. 10.

Further details of the channel 230 and the partitions 260 are shown in FIG. 19. The sides 266 of the channel 230 and the partitions 260 are vertically coplanar. The webs 232 are also coplanar in a horizontal plane with additional webs **232*a* provided integral with and projecting between selected webs 262. Additional web sections 268 are provided integral with the channels 266 and the partitions 260. These web sections 268 are coplanar in another horizontal plane, with a rail receiving passageway defined between the horizontal planes, and more particularly between the web sections 268 and the webs 232; 232*a*. The webs alternate in position along the length of the tray to permit molding thereof in a single split mold. Shown in FIGS. 10, 12, 17 and 18 is a flat plate rail 270 with an upstanding T-head 272. The tray 193 includes elongate integral plate form feet 269 which are slidable along the rail 270 with the T-head thereof slidably received between the horizontal planes whereby the webs 230; 230***a* overlies the T-head and the web sections 268 lie under the widened portion of the T-head, captivating the T-head between the horizontal planes. In practice, the T-head rail 220 is mounted in a machine (not shown) such as image copying on duplication machine, and the corotron is placed in registration on the rail 270 and is slidable therealong as a technique for removably incorporating the corotron in the machine.

During manufacture, the tray will have a slight permanent bow or inverted arch shape, which is so slight it is not shown in the drawings. The arch shape therefore must be straightened in order for the webs 268 to become coplanar and captivated under the T-head 272. Thus as the tray is slidable along the rail 270, the webs 268, and particularly the first and last webs 268, i.e., at the inboard and outboard ends of the tray, will be compressed against the undersurface of the T-head 272. This forces the tray to assure a straightened configuration, with the feet 269 compressed vertically downward as shown in the drawings on the tray 272, and with the webs 268, particularly the first and last webs 268 in compression vertically upward on the undersurface of the T-head 272, thereby rigidly supporting the tray on the rail forcing the tray to assume a desired configuration, in this case a straightened configuration. Thus the webs and feet of the tray are useful for grippingly engaging the rail and for forcing the rail to assume the configuration of the rail.

Also the slidable motion of the corotron along the rail 270 advantageously is used for coupling the bushings to corresponding sources of voltage (not shown). In this manner all the electrical connections of the corotron are made at the inboard end 194 which can be located deeply within the confines of the machine incorporating the corotron; and the slidable assembly of the corotron to the rail 270 assures proper orientation of the corotron so that bushings may be plugged deeply within the confines of the machine and into the high voltage sources without difficulty.

Referring to FIGS. 16–18, there is shown a molded dielectric cover 274 having a horizontally projecting integral loop handle 276 which is manually utilized to pull on the corotron when slidably displacing the same along the rail, for example, to disconnect the corotron from sources of high voltage. The cover is provided with a plurality of integral depending flanges 278 the outermost ones of which are provided with horizontal ribs 280 which are latchable under corresponding ribs 282 on the tray sidewalls 220. The ribs 280 may be forcibly inserted past the ribs 282 when the cover 274 is vertically pressed into engagement and assembly over the pillars 246 and 248 and the partitions 260. The cover has an additional depending pair of flanges 284 extending perpendicular to the flanges 278. The flanges 284 are inserted vertically between the tray sidewalls 220 on either side of the pillar 248. One of the flanges 284 forms an end plate for the tray 193 and the other flange 284 is inserted between the pillars 248 and the pillar 246 mechanically interlocking the cover 274 and the tray 193 and anchoring the cover to the tray. As shown in FIG. 16, the outermost flanges 278 are provided with inverted notch portions 286 which overlie and engage the end portions of the channel-shaped plate conductors 216 to retain the same assembled on the tray bottom wall 222. As shown in FIG. 18, the cover 274 further includes integral depending tabs 288 which fit within widened portions 290 of the grooves 254.

A major advantage of the embodiment of FIGS. 10–19 is the ability of the conductors 140 to carry voltages of different levels or AC voltages of different phase. To do so, however, creepage and clearances must be satisfied to eliminate shock hazard and/or internal breakdown between conductive parts from undesired voltage tracking from the voltage carrying components to the nearest external surfaces of the corotron dielectric components. The corotron of the present embodiment has a construction which specifically meets the requirements for adequate creepage and clearances. As shown in FIGS. 16–18 spaces are defined adjacent the pillars 246 and the sidewalls 220, and also adjacent the pillars 246 and the partitions 260. The cover 274 when assembled over the partitions 260 and the pillars 246 has the depending flanges 278 inserted into and substantially filling the spaces which extend lengthwise of the tray.

Relatively lengthy voltage tracking paths are provided along the interface of the cover 274 and pillars 246. More specifically, voltage tracking must occur by originating from the voltage carrying conductors in the cavities 252 or grooves 290. A clearance tracking path through the shortest distance in the space between a pillar 246 and a sidewall 220 is eliminated by the presence of a flange 278 in the space. This force voltage tracking by creepage vertically down a vertical side of a pillar 246 and then around the terminus of a corresponding flange 278 and then upwardly along a vertical sidewall 220. Due to the relatively lengthy creepage path, voltage tracking will not occur at the sidewall 220.

In addition, a corresponding flange 278 is interposed in the space between a pillar 246 and an adjacent partition 260. The presence of such flange and an adjacent partition prevents voltage tracking across the free space between a pillar 246 and the rail head 272. The interposed flange 278 prevents voltage tracking in the clearance directly from a pillar 246 to a partition 260 and instead provides a relatively lengthy voltage tracking path by creepage down a vertical surface of a pillar and up around the terminus of the interposed flange 278 and upwardly along the vertical surface of a partition 260. Due to the relatively lengthy creepage path voltage creepage out from the partition 260 or shorting to the rail head 272 will not occur.

Similarly the flange 284 interposed in the free space between the pillars 246 and 248 provides a relatively lengthy voltage path down the vertical surface of the pillars 246 and then around the terminus of the interposed flange 284 and then upwardly along the vertical surface of the pillar 248. Voltage creepage does not occur from the vertical surface of the pillar 248.

Along the length of the tray 193, in the free space between the end block 196 and the pillars 246, the partitions 260 interposed between the plate conductors 214 are of sufficient vertical height to provide adequate voltage creepage and clearance separation of the plate conductors 214 from each other and also from the rail head 272.

The shortest distance in free space from the plate conductors to the rail head as well as the shortest distance from the plate conductors along the surface of the tray bottom wall 222 to the rail head 272 must be sufficiently lengthy to prevent voltage tracking to the rail head 272.

As shown in FIG. 10, a relatively low vertical partition 292 is provided integral with the bottom wall 222 and is interposed between a plate conductor end portion 216 and the channel 234 containing the rail head 272. This partition is overlaid by a complementary shaped undercut 294 in the block 196 providing a lengthy voltage tracking path at the interface of the block 196 and partition 292. Voltage tracking must occur along the interface in accordance wwith the principles of operation heretofore explained.

As shown in FIG. 10, the partition 292 is L-shaped with a return 296 along the open end of the tray 193. This return 296 prevents voltage tracking from the plate conductor end 216 around the end of the partition to short to the rail head 272.

Figure 15:
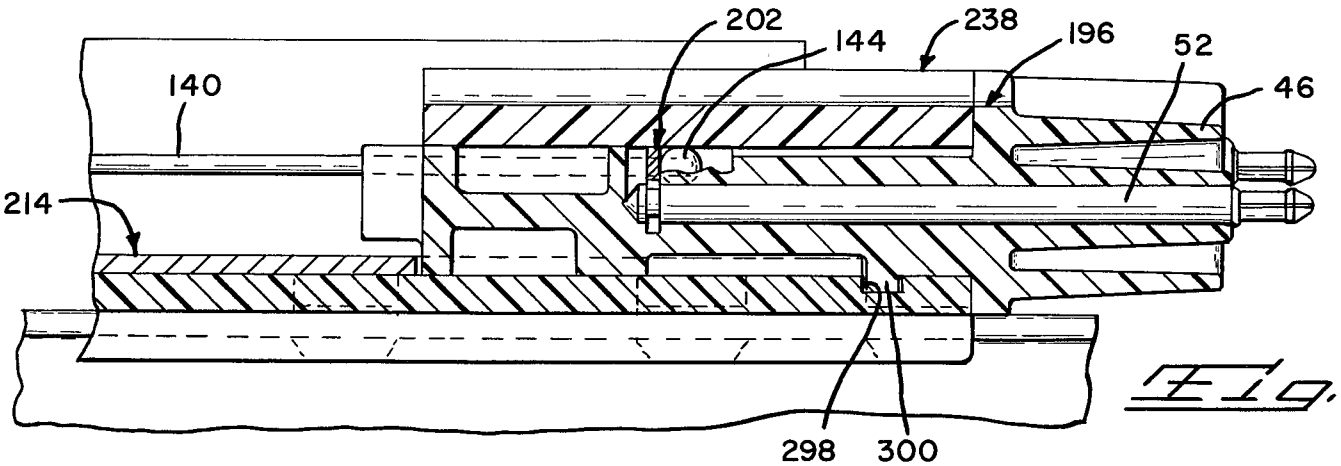
FIG. 15 is an enlarged fragmentary section taken along the line 15—15 of FIG. 10.

As shown in FIGS. 10, 14 and 15, adjacent the return 296, the tray bottom wall 222 is provided with a vertically recessed groove 298, the block 196 having a complementary shaped projection 300 which fills the groove 298. A lengthy tracking path is provided along the interface of the groove and projection 300, from the nearby plate conductor end 216 and around the return 296 to the rail head 272. Voltage shorting from the conductor end 216 to the rail head 272 is thereby prevented.

As shown in FIGS. 10, 12 and 13, a vertical wall 301 is provided on the end block 196. Each interconnected recess 200 and groove 208 have their perimeters circumscribed by an immediately adjacent vertical wall 301 portion 302 of the wall 301 integral with the block 196. The groove 308 projects through the wall portion 302 but otherwise the wall is continuous. Additional integral portions 304 of the wall 301 run lengthwise of the block top and are interposed between the contacts 200 and the grooves 208. Additional integral portions 306 of the wall 301 run lengthwise of the block top and are adjacent to but slightly spaced from the tray sidewalls 220. The cover 238 includes integral depending flanges 308 which are disposed closely adjacent the vertical surfaces of the wall 301. More specifically some of the flanges 308 are interposed between all portions 306 and the sidewalls 220 of the tray. This provides a relatively lengthy voltage tracking path from the recesses 198 over the top of the wall portions 302 and down the vertical surface thereof, then around the edge of the closely adjacent flange 308 and then upwardly along the interface of the flange 308 and the sidewall 220. The tracking path is sufficiently lengthy to prevent voltage tracking before voltage emerges at the outside surfaces of the block 196, the tray 193 or the cover 238.

Similarly, the flanges 308 closely adjacent the wall portions immediately encircling the grooves 208 and cavities 200 insure lengthy voltage tracking downwardly of the vertical surfaces of such wall portions. As shown in FIGS. 12 and 13 the flanges 308 also are interleaved with the wall portions 302 and 304 to provide a relatively lengthy voltage tracking path at the interface between the flanges 308 and the vertically projecting surfaces of the wall portions which are located between the contact recesses 198 and between the grooves 208. A relatively lengthy and circuitous voltage tracking path therefore is provided first over the vertically upward projecting wall portions 302 and 304 and also under the interleaved flanges 308. Such lengthy path prevents voltage arcing between contacts 200.

Although preferred embodiments of the present invention have been described in detail other modifications and embodiments which would be obvious to one having ordinary skill in the art are intended to be covered by the spirit and scope of the appended claims.

What is claimed is:

1. In a corotron having plate conductors mounted on a bottom wall of an elongate dielectric tray and elongate conductors supported along said tray in vertical spaced relationship from said plate conductors, the improvement comprising:

a dielectric end block at a first end of said tray confined between vertically projecting sidewalls of said tray, said end block having integral projecting rigid dielectric bushings encircling conductor means exposed from said bushings for connection to corresponding sources of voltage;

said conductor means projecting into said end block with selected ones electrically inserted in corresponding plate conductors and with selected ones being electrically connected to electrical contacts within top accessible contact receiving recesses provided in said end block;

said elongate conductors having portions thereof received and supported in said top accessible recesses of said end block with further portions of said elongate conductors received in said contact receiving recesses and electrically connected to said electrical contacts;

said end block further being provided with integral vertically projecting wall means extending continuously along both sides of a corresponding groove and the perimeter of a corresponding contact receiving recess;

a dielectric cover vertically assembled over said end block and covering said elongate conductor portions received in said end block grooves;

said cover including integral depending flange means surrounding said wall means on said end block;

said wall means cooperating with said cover and with said flange means to define an interface which provides lengthy voltage tracking paths from said recesses to the nearest external surfaces of said cover and the nearest external surfaces of said end block and between internal conductive parts;

said tray bottom wall having a surface portion between one said plate conductors and said one end of said tray;

said end block having a stepped configuration complementary to said stepped surface portion and vertically overlying said stepped surface portion to provide at the interface there between a relatively lengthy voltage tracking path from said plate conductor to the nearest exposed surface of said tray;

another end of said tray including vertically projecting pillars integral with said bottom wall and provided with vertically recessed top accessible cavities containing tensioning recesses for said elongate conductors;

said pillars further including vertically recessed top accessible grooves communicating with an end wall of said pillars and said cavities;

said elongate conductors having portions received and supported in said grooves of said pillars and portions connected to said terminating means;

said elongate conductors extending along said tray in free space between said end block and said pillars;

a dielectric cover overlying said pillars and having depending flanges means surrounding said pillar and defining there between relatively lengthy voltage tracking paths from said cavities to the corresponding nearest exposed external surfaces of said tray and of said pillars and between internal conductive parts; and dielectric partitions integral with said bottom wall of said tray and separating said plate conductors.

2. The structure as recited in claim 1 and further including:

an open channel extending lengthwise of said tray;

said partitions being adjacent said channel separating said channel from said plane conductors; and a plurality of dielectric web sections integrally joining said partitions and bridging across said channel;

said web sections being alternately space lengthwise of said channel, and alternately disposed in two horizontal planes to define a horizontal rail receiving passageway between said horizontal planes.

3. In a corotron having a molded dielectric tray supporting plate conductors therein and dielectric end blocks with elongate conductors supported by said end blocks for precise alignment thereof in free space between said end blocks and along said tray in spaced relationship with respect to said plate conductors, the improvement comprising:

one of said end blocks being integral with said tray and being divided into spaced vertically projecting pillars receiving and supporting said elongate conductors;

portions of said plate conductors being mounted removably in said tray;

said tray having integral vertically projecting partitions interposed between said plate conductors and providing lengthy voltage tracking paths separating said plate conductors;

another of said end blocks being removably mounted on said tray and including electrical connector means for removably connecting said plate conductors and said elongate conductors to corresponding sources of voltage;

portions of said plate conductors being overlaid by said removable end block and thereby retained on said tray;

said partitions being overlaid by a dielectric cover;

other portions of said plate conductors being overlaid by depending portions of said cover and thereby retained on said tray;

said dielectric cover having depending flange portions circumscribing vertical surfaces of said partitions to define lengthy voltage tracking paths from the portions of said elongate conductors supported by said partitions to the nearest external surfaces of said tray and of said cover and between internal conductive parts.

4. The structure of claim 3 wherein said tray includes integral vertically projecting sidewalls containing therebetween said end blocks, said plate conductors and said elongate conductors, said sidewalls including integral projecting ribs, and said cover being laterally secured to said projecting ribs.

5. In a corotron including a dielectric elongated tray provided with dielectric end blocks, said end blocks in turn provided with first electrical connector means for connecting plate conductors mounted on the tray to sources of voltage externally of said corotron and with second electrical connector means for connecting elongate electrical conductors mounted on said end block to sources of high voltage externally of said corotron, the improvement comprising:

recesses in said end blocks;

each end block having grooves communicating with said recesses, the grooves of one end block being aligned with the grooves of the other end block;

said end blocks overlying portions of said plate conductors and being removable from said tray to allow removal of said plate conductors;

said elongate conductors being secured at one end to tensioning means mounted in the recesses of one end block, said elongate conductors being secured at opposite ends to electrical contacts mounted in recesses of the other end block and connecting the elongate conductors with corresponding electrical connector means;

said tensioning means continuously applying tension on said conductors, and said conductors extending from one end block to the other in free space and in spaced relationship from said plate conductors.

6. The structure of claim 5, and further including: rail means, said tray being slightly bowed from one end to the other, and said tray having means thereon grippingly engaging said rail and forcing said tray to assume the configuration of said rail.

7. The structure as recited in claim 5, and further including:

solid dielectric means engaging and covering corresponding end blocks and covering said tensioning means, said contacts and portions of said conductors contained in said end blocks;

one end block overlies portions of said plate conductors, and said dielectric means covering the other of said end blocks includes integral depending portions overlying other portions of said plate conductors.

8. In a corotron including a dielectric tray and plate form conductors mounted on said tray and elongate conductors in vertical spaced relationship from said plate conductors, together with electrical connecting means electrically connecting said plate conductors and said elongate conductors to corresponding voltage sources, the improvement comprising:

a dielectric block removably mounted at one end of said tray and provided with said electrical connecting means;

said block overlying said plate conductors to retain them in said tray;

a plurality of pillars integral with said tray and spaced from said dielectric block;

said elongate conductors being mounted on said pillars and on said block bridging across the free space between said pillars and said block;

said block and said pillars each being provided with a dielectric cover overlying portions of said elongate conductors, said cover on said pillars including integral depending flange portions circumscribing said pillars to provide lengthy voltage tracking paths from said elongate conductors over the surfaces of said pillars to the adjacent conducting parts and to the nearest external surfaces of said tray and said cover which overlies said pillars.

9. The structure recited in claim 8 and further including tensioning means connected to said elongate conductors and mounted therewith on said pillars, whereby said elongate conductors are continuously tensioned by said tensioning means.

10. The structure as recited in claim 9 wherein said pillars are provided with top accessible cavities receiving said tensioning means and portions of said elongate conductors, said block is provided with top accessible recesses receiving electrical contacts and portions of said elongate conductors connected to said electrical contacts, and said pillars and said block are provided with top accessible grooves receiving and vertically supporting portions of said elongate conductors for precise vertically spaced alignment with said plate conductors.

11. In a connector for a corotron wherein an elongated conductor carrying a high voltage electrostatic charge is maintained in free space by a dielectric housing having an inboard end adapted for pluggable connection to a source of high voltage and an outboard end adapted for safe handling by a user of the connector, the improvement comprising:

a tray of dielectric material having a channel shape defined by a bottom wall and integral side walls projecting outwardly of said bottom wall, an inboard end of said tray being provided with an inboard end block having an enlarged end plate, a molded rigid dielectric electrical bushing encircling first conductor means being exposed from said bushing for connection to a source of high voltage, said first conductor means further projecting into a top accessible recess of the inboard end block and being electrically connected to a contact received in said recess, the outboard side of the connector being provided with an outboard end block latchably mounted on said tray, a molded electrical bushing encircling a second conductor means which projects through a portion of the outboard end block and resiliently engages a corresponding plate conductor mounted on a bottom wall of said tray, said plate conductor being captivated in grooves of the side walls and engaged against and between said end blocks, at least one elongated conductor electrically connected to said contact and retained in a top accessible recess of said outboard end block, each end block having means in the top surface thereof receiving and supporting portions of said conductor.

12. The structure as recited in claim 11, wherein, said conductor is vertically recessed in each of said end blocks and is horizontally held in tension by coil springs compressed within one of said end blocks.

13. The structure of claim 11, wherein, said conductor receiving and supporting means in each end block comprises vertically recessed grooves in mutual alignment and vertically supporting portions of said conductor for precise alignment thereof in free space within the confines of said tray, and further including:

cover plates vertically assembled and latchably secured over said end blocks covering said grooves and portions of said conductors supported in said grooves.

* * * * *